US006095633A

United States Patent [19]

Harshbarger et al.

[11] Patent Number: 6,095,633

[45] **Date of Patent: *Aug. 1, 2000**

[54] PROCESS FOR PRIMING A MULTI-CHAMBER INK JET PRINT HEAD

[75] Inventors: Kenneth James Harshbarger, Lexington; Austin Keith Wickline, Stanton, both of Ky.

[73] Assignee: Lexmark International, Inc., Lexington, Ky.

[ * ] Notice: This patent issued on a continued prosecution application filed under 37 CFR 1.53(d), and is subject to the twenty year patent term provisions of 35 U.S.C. 154(a)(2).

[21] Appl. No.: 08/319,174

[22] Filed: Oct. 6, 1994

[51] Int. Cl.[7] ..... B41J 2/165

[52] U.S. Cl. ..... 347/30; 347/32

[58] Field of Search ..... 347/30, 24, 92, 347/22, 26, 32

[56] References Cited

U.S. PATENT DOCUMENTS

| | | | |
|---|---|---|---|
| 4,558,326 | 12/1985 | Kimura et al. | 347/30 |
| 4,947,191 | 8/1990 | Nozawa et al. | 347/30 |
| 4,965,596 | 10/1990 | Nagoshi et al. | 347/36 |
| 5,138,334 | 8/1992 | Rowe et al. | 347/25 |
| 5,185,614 | 2/1993 | Courian et al. | 347/30 |

FOREIGN PATENT DOCUMENTS

| | | | |
|---|---|---|---|
| 363094855 | 4/1988 | Japan | 347/92 |
| 63-094855 | 4/1988 | Japan | 347/92 |

*Primary Examiner*—N. Le
*Assistant Examiner*—Shih-Wen Hsieh
*Attorney, Agent, or Firm*—John A. Brady

[57] ABSTRACT

Pressure is applied to a resilient seal around the venting portion of a print head while the nozzles are elevated in the vertical position above the ink, thereby forcing ink out of the nozzles and purging the in-flow paths of air.

5 Claims, 1 Drawing Sheet

PROCESS FOR PRIMING A MULTI-CHAMBER INK JET PRINT HEAD

TECHNICAL FIELD

The present invention is concerned with a process for priming a multi-chamber ink jet print head. By means of the process offending air bubbles are purged from the ink flow paths leading to each nozzle array.

BACKGROUND INFORMATION

During the manufacture of ink jet print heads, difficulty is experienced in removing air bubbles from the ink flow path. The presence of such bubbles is obviously a serious detriment to the quality of the resulting print. To remove the bubbles, a priming process is used.

In the prior art, the conventional way to carry out such a priming process has been by means of a vacuum source placed in fluid communication with the orifice set to withdraw ink from the supply compartment and out through the orifice set. See, for example, U.S. Pat. No. 5,185,614, and the art discussed therein.

DISCLOSURE OF THE INVENTION

It has now been found that a multi-chamber ink jet print head can be purged of offending air bubbles by a priming process in which pressure is applied to a resilient seal positioned around the venting portion of the print head, the pressure being applied while the nozzles are positioned so that they are elevated in the vertical position above the ink. Excess ink expelled from the nozzles is then drawn away by means of suction tubes placed near the corresponding nozzles. The mixing of ink from different chambers is thereby prevented. Because the inks in different chambers are usually of different colors, this is an important economic advantage.

DESCRIPTION OF THE DRAWINGS

In FIG. 1, 1 is a fixture to which the head is attached; 2 is an ink reservoir which includes an ink-saturated foam; 3 is an ink channel; 4 is the nozzle area (wherein the print head chip is not shown); 5 is the print head; 6 is a resilient seal, and 7 is a valve; 15 is a vent hole to one of the ink reservoirs.

In FIG. 2, 8 is a filter; 9 is the print head body; 4 is the nozzle area (wherein a print head chip assembly 16 having an illustrative diagrammatic nozzle 17 is shown); 11 is the ink in the ink channel; 12 shows bubbles in the ink; 13 is a plug, and 14 is the ink-saturated foam in the ink reservoir 2. (Note that the print head of FIG. 2 has ink in it, but that in FIG. 1 does not).

As shown in FIG. 1, the print head 5 is placed in a fixture 1 with the nozzle area 4 elevated above the ink reservoir 2 (foam). A resilient material 6 seals the fixture to the reservoir end of the print head 5, enclosing the print head vent hole(s) 15 to each of the print head chambers. The fixture includes a conduit which connects the vent holes to a pressure source, separated by a valve 7. Identical conduits exist for each chamber of the multi-chamber print head.

During the priming process, the conduit valve is opened to the pressure source, so that pressure is applied to the ink-saturated foam. This pressure is regulated to urge ink to travel from the foam, through any filter, and fill the channel and a nozzle array in a print head chip in the nozzle area.

Figure 1:
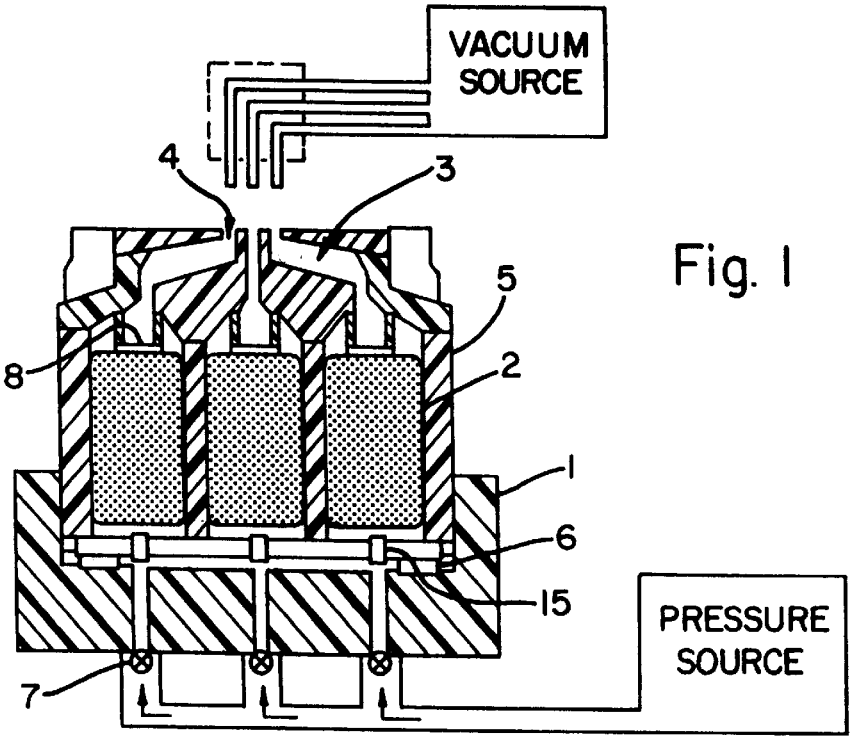
FIG. 1 is a schematic cross-sectional diagram of a multi-chamber ink jet print head. The head is in the upside-down position.
Figure 2:
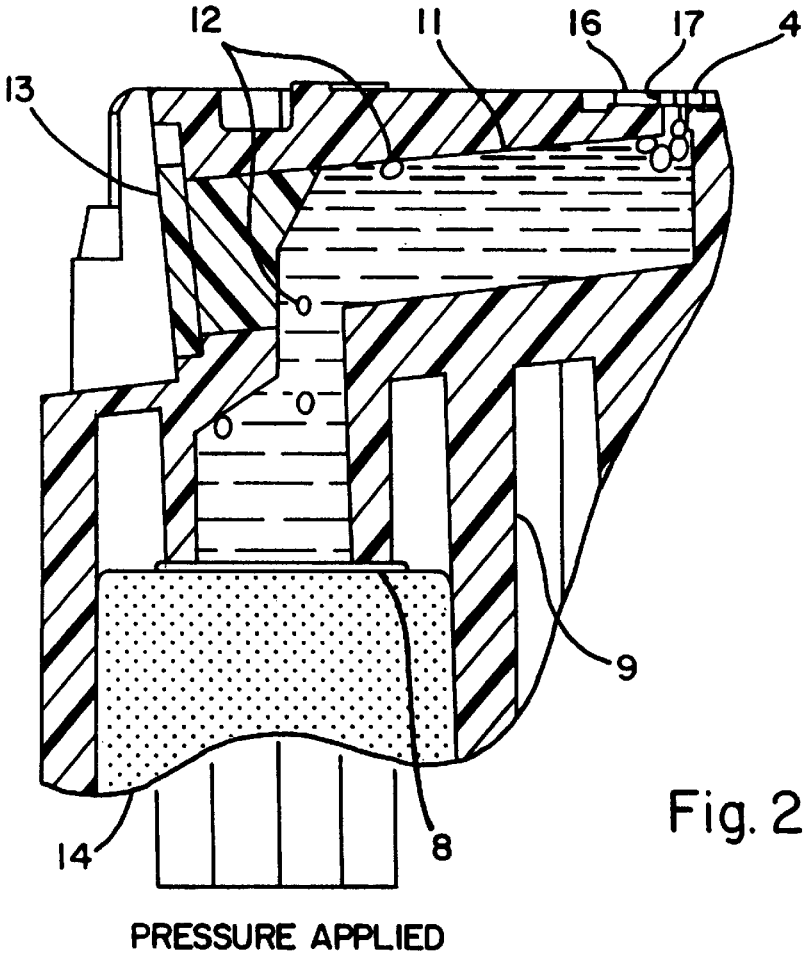
FIG. 2 is a schematic cross-sectional diagram of one of the chambers of the multi-chamber print head. It is also in the upside-down position.

As shown in FIG. 2, when the conduit valve is open, pressure from the pressure source passes through the conduit to increase the partial pressure on the vented end of the ink reservoir 2. The regulated pressure transfers through the foam 14, forcing ink to travel from the foam, through the filter 8, and fill the channel 11 and a nozzle array in the print head chip 16. In the current invention the positive gauge pressures are quickly activated, whereas vacuums may require a lengthy time for the evacuation of air. Positive pressures may also be very well regulated, at a lower cost, than negative gauge pressures, or vacuums. With such additional control, a pressure priming system is more accurate and wastes less ink than the vacuum priming system of the prior art.

The buoyancy forces on any bubbles left in the channels 11 (the path between the foam and the nozzle array) will cause the bubbles to rise upward. When the print head is oriented as described above for the present invention, the nozzles are elevated over the ink supply, and any bubbles in the flow channels rise to the nozzle area, where they coalesce.

While pressure forces urge the ink to travel through the flow channels and the nozzles such as 17, air bubbles in the channels are carried along with the fluid flow. These bubbles are then swept out of the head through the nozzles with the ink. When the print head is aligned with the nozzles elevated, bubbles collect at the nozzle area due to buoyancy forces. These collected bubbles are easily swept with the fluid flow out of the nearby nozzles. The buoyancy forces combine rather than compete with the kinetic forces of the traveling fluid to remove air bubbles from the print head. In a normal printing orientation, as with prior art, bubbles float to the filter, and buoyancy forces must be overcome to push or suck these bubbles from the print head. In the present system, rather than floating toward the filter where they cannot be removed, air bubbles rise to the channel exit under buoyancy forces and are simply purged from the nozzles by the flow of ink.

If the print head channel is designed with dead zones, where stagnant fluid or multi-directional channels would trap bubbles, the bubbles would be prevented from collecting near the nozzle area. Print heads which have multi-directional segments in channels allow bubbles to flow up into these traps. By orienting the head so that the channel is vertically aligned and the nozzle area elevated, the buoyancy force of the bubbles will carry the bubbles out of the trap and toward the nozzle area. For print heads with stagnant zones in the fluid channels, a mechanical shock against the side wall of the print head can be used to release the bubble into the fluid flow path, where it may be carried to the nozzle area. Well-designed print heads employ a body and channel system which naturally exploit buoyancy forces of bubbles to allow the collection of bubbles at the nozzle end of a print head channel, when the nozzle area is elevated.

The priming methods are considered identical for every chamber in the multi-chamber print head. Each chamber is pressurized so that the ink is forced to fill the channels and nozzles. Each chamber is also oriented (in separate steps, if necessary) so that the nozzle area is elevated to a maximum height over the ink reservoir, making the channels as vertical as possible. Chambers may be pressurized (or primed) individually or together. When mechanical shocks are employed, priming all chambers together will prevent any chambers from gulping air through the nozzles, due to the outward flow of ink through those nozzles.

In the most preferred embodiment of the invention, suction tubes are placed in close range to the nozzle area. Each tube is positioned directly over an associated nozzle array. The tubes merge and are then connected to a vacuum source. A single suction tube is positioned a specific distance 'D' from its corresponding nozzle array. This distance is large enough that the suction tubes alone will not urge ink from the nozzles themselves when vacuum is activated. This distance 'D' is also small enough that the suction tubes remove any residual ink from the nozzle area, once the pressure has been activated (or the head has been primed) 'D' is from about one thirty-second to about one quarter of an inch, preferably about one eighth of an inch. This residual ink is removed by the suction tubes prior to reaching a neighboring nozzle array, thus preventing ink from one chamber from mixing with that of another chamber. The vacuum source and the suction in these tubes may remain on (unlike the valving and careful vacuum regulation required by prior art), because they are involved in removing excess ink and preventing ink mixing, and they do not affect the condition of the ink in the nozzles.

The pressure applied to the resilient seal should be from about 0.5 pound per square inch to about 10 pounds per square inch. A pressure of about 2 pounds per square inch is preferred. When the pressure is too low, priming does not take place. On the other hand, when the pressure is too high, the ink keeps flooding out of the nozzles when they have been returned to the normal printing position, i.e., facing downward.

What is claimed is:

1. A process for priming a multi-chamber ink jet print head having an array of nozzles, a color ink associated with each chamber in fluid communication with said nozzles, each ink in each said chamber being a different color, and a venting portion for venting each said chamber, said process comprising the steps of:

positioning a resilient seal around said venting portion of the print head;

positioning the nozzles so that said nozzles are elevated in the vertical position above the ink;

applying pressure to the vent side of the resilient seal so that each chamber of the print head is pressurized and ink is forced through the nozzles; and applying a vacuum in the vicinity of said nozzles sufficient to remove residual ink from the region of said nozzles resulting from said applying pressure while insufficient to draw ink from said nozzles, wherein mixing of inks on said print head from different chambers is prevented.

2. A process as claimed in claim 1 wherein any bubbles in the ink path are purged from the print head by the outward flow of the ink.

3. A process as claimed in claim 1 wherein the pressure applied to the resilient seal is from about 0.5 to about 10 pounds per square inch.

4. A process as claimed in claim 3 wherein the pressure is about 2 pounds per square inch.

5. A process as claimed in claim 3 wherein each suction tube is about one thirty second to one quarter of an inch from the corresponding nozzle.

* * * * *

UNITED STATES PATENT AND TRADEMARK OFFICE

CERTIFICATE OF CORRECTION

PATENT NO. : 6,095,633
DATED : August 1, 2000
INVENTOR(S) : Kenneth J. Harshbarger; Austin K. Wickline It is certified that error appears in the above-identified patent and that said Letters Patent is hereby corrected as shown below:

Column 4,
Line 30 change "3" to read -- 1 --.

Signed and Sealed this

Fourteenth Day of August, 2001

*Attest:*

Nicholas P. Godici

*Attesting Officer*

NICHOLAS P. GODICI
*Acting Director of the United States Patent and Trademark Office*